US007142042B1

(12) United States Patent
Henry

(10) Patent No.: US 7,142,042 B1
(45) Date of Patent: Nov. 28, 2006

(54) NULLED ERROR AMPLIFIER

(75) Inventor: Paul M. Henry, Tucson, AZ (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 10/651,849

(22) Filed: Aug. 29, 2003

(51) Int. Cl.
*G05F 1/10* (2006.01)

(52) U.S. Cl. ..... 327/538; 327/540

(58) Field of Classification Search ..... 327/307, 327/538, 540, 541, 543; 323/313; 330/51
See application file for complete search history.

(56) References Cited

U.S. PATENT DOCUMENTS

| | | | | | |
|---|---|---|---|---|---|
| 3,670,148 | A * | 6/1972 | Moses | ..... | 700/79 |
| 4,972,157 | A * | 11/1990 | Moyal | ..... | 330/51 |
| 5,077,541 | A * | 12/1991 | Gilbert | ..... | 330/284 |
| 5,493,243 | A * | 2/1996 | Ghoshal | ..... | 327/158 |
| 5,581,213 | A * | 12/1996 | Linder et al. | ..... | 330/282 |
| 5,847,670 | A | 12/1998 | Gratrex et al. | ..... | 341/159 |
| 6,040,718 | A | 3/2000 | Henry | ..... | 326/71 |
| 6,040,732 | A * | 3/2000 | Brokaw | ..... | 327/408 |
| 6,093,981 | A * | 7/2000 | Cali' et al. | ..... | 307/113 |
| 6,201,378 | B1 * | 3/2001 | Eto et al. | ..... | 323/313 |
| 6,313,694 | B1 * | 11/2001 | Sohn | ..... | 327/541 |
| 6,445,248 | B1 * | 9/2002 | Gilbert | ..... | 330/51 |
| 6,535,054 | B1 | 3/2003 | Ceekala et al. | ..... | 327/539 |
| 6,653,900 | B1 * | 11/2003 | Bu | ..... | 330/253 |
| 6,657,487 | B1 * | 12/2003 | Lauffenburger et al. | ..... | 330/9 |

OTHER PUBLICATIONS

Grebene, Alan, "Bipolar and MOS Analog Integrated Circuit Design," *John Wiley & Sons,* 1939, 1984 (9 pgs).
Razavi, Behzad, "Design of Analog CMOS Integrated Circuits," *McGraw Hill,* 2001, (5 pgs).
Li, Tao, et al. A Low Voltage Bandgap Reference Circuit with Current Feedback, *University of Michigan Design Contest Report,* Fall, 2003 (5 pgs).
Gupta, Vishal, et al., "Predicting and Designing for the Impact of Process Variations and Mismatch on the Trip Range and Yield of Bandgap References," *IEEE Quality of Electronic Design Symposium,* Mar. 21-23, 2005 (7 pgs).
"Offset Null," *Answers Corporation,* 2006 (2 pgs).

* cited by examiner

*Primary Examiner*—Linh My Nguyen
(74) *Attorney, Agent, or Firm*—Brett A. Hertzberg; Merchant & Gould PC

(57) ABSTRACT

A multi-stage amplifier circuit that is arranged to minimize offset related errors in a reference circuit. The first stage circuit includes an array of amplifier circuits that receive feedback signals. The outputs of the first stage amplifier circuits are coupled together to a common node. The second stage circuit is also coupled to the common node, and arranged to drive a feedback circuit to generate the feedback signals. In one example, the feedback circuit includes a band-gap core. The second stage circuit can be arranged as part of a low-drop out (LDO) regulator. Each of the amplifier circuits in the first stage can be nulled in response to null control signals from a null control logic circuit. The overall offset in the resulting reference circuit is reduced by the selective nulling of the arrayed amplifiers in the first stage circuit.

22 Claims, 6 Drawing Sheets

NULLED ERROR AMPLIFIER

FIELD OF THE INVENTION

The present invention is related to a method and system for reducing offset related errors in a voltage reference circuit. More particularly, the present invention is related to an array of amplifiers that are configured to minimize the effects of offset voltages in a voltage reference circuit.

BACKGROUND OF THE INVENTION

Band-gap voltage references are used as voltage references in electronic systems. The energy band-gap of Silicon is on the order of 1.2V, and is independent from temperature and power-supply variations. Bipolar transistors have a negative temperature drift with respect to their base-emitter voltage (Vbe decreases as operating temperature increases on the order of −2 mV/deg C). However, the thermal voltage of a bipolar transistor has a positive temperature drift (Vt=kT/q, thus Vt increases as temperature increases). The positive temperature drift in the thermal voltage (Vt) may be arranged to compensate the negative temperature drift in the bipolar transistor's base-emitter voltage. Band-gap reference circuits use the inherent characteristics of bipolar transistors to compensate for temperature effects and provide a stable operating voltage over various power-supply and temperature ranges.

An example band-gap reference circuit is illustrated in FIG. 6. As shown in the figure, two bipolar transistors (Q61, Q62) are arranged with a common base. Two resistors (R61, R62) are series connected between the emitter of the first bipolar transistor (Q61) and the reference output. Another resistor (R63) is connected between the emitter of the second bipolar transistor and the reference output. An error amplifier (EAMP) is used to adjust the voltage of the reference output (VREF) via transistor MLDO. At steady-state, the voltage at the common point of resistors R61 and R62 is the same as the voltage at the emitter of the second bipolar transistor (Q65). The two bipolar transistors (Q61, Q62) are arranged to provide a ten-to-one (10:1) current density difference with respect to one another. The ten-to-one current density results in a 60 mV difference between the base-emitter voltages of two bipolar transistors ($\Delta Vbe=Vt*1n(I1/I2)=26\ mV*1n(10)=60\ mV$, at room temperature). The 60 mV difference appears across the first resistor (R61). The voltage between the drain of transistor MLDO and ground provides a voltage reference (VREF) that is given as VREF=Vbe+X*Vt, where X is a constant that is used to scale the temperature correction factor. The temperature correction factor (X) is adjusted by the ratio of the resistors. Typical temperature corrected reference voltages of 1.25V are achieved by this configuration.

BRIEF DESCRIPTION OF THE DRAWINGS

Non-limiting and non-exhaustive embodiments of the present invention are described with reference to the following drawings.

DETAILED DESCRIPTION OF THE PREFERRED EMBODIMENT

Figure 1:
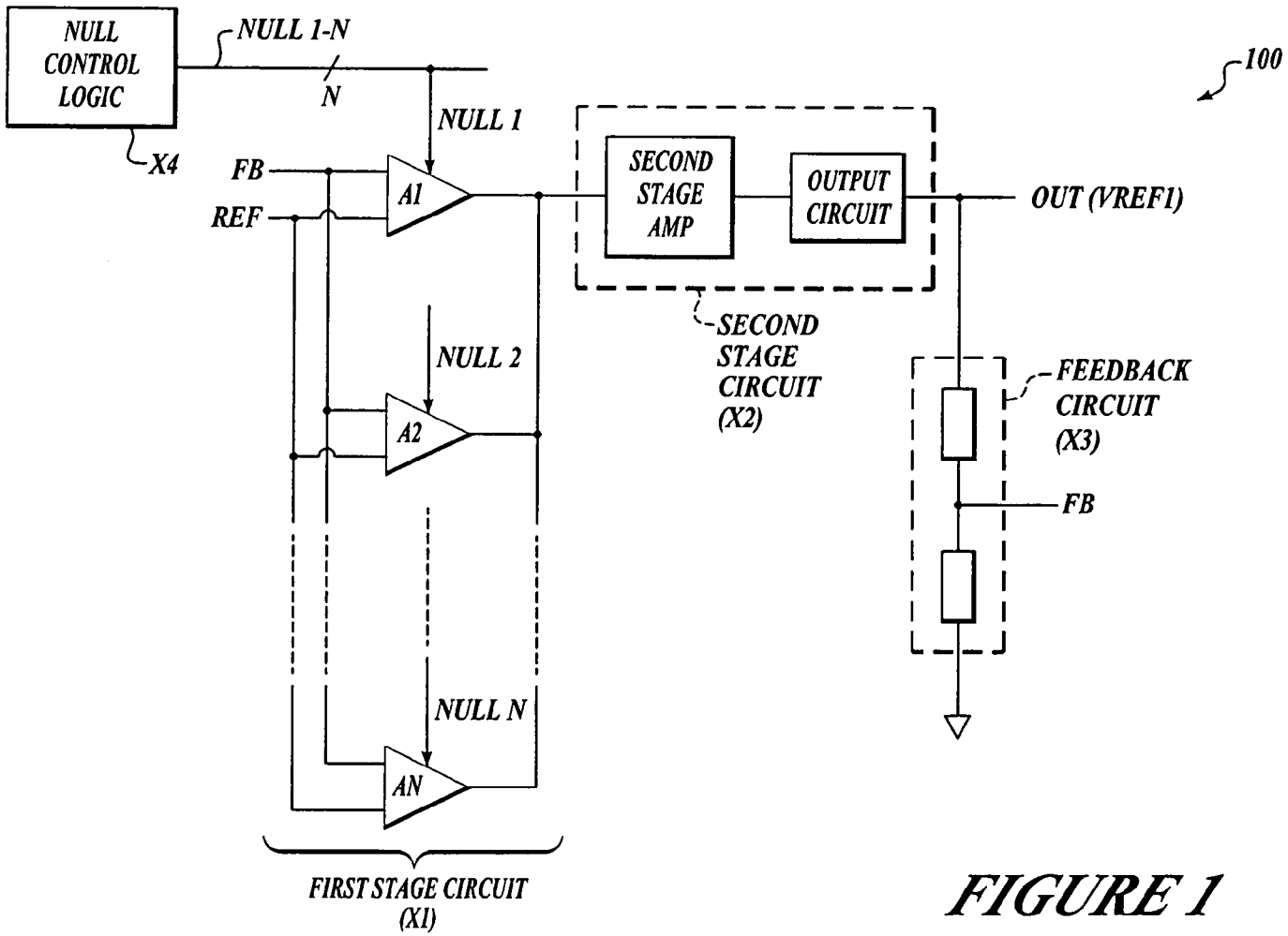
FIGS. 1–5 are illustrative schematic diagrams for circuits that are each arranged in accordance with an embodiment of the present invention.

Various embodiments of the present invention will be described in detail with reference to the drawings, where like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

Throughout the specification and claims, the following terms take at least the meanings explicitly associated herein, unless the context clearly dictates otherwise. The meaning of "a," "an," and "the" includes plural reference. The meaning of "in" includes "in" and "on." The term "connected" means a direct connection between the items connected, without any intermediate devices. The term "coupled" refers to both direct connections between the items connected, and indirect connections through one or more intermediary items. The term "circuit" may refer to both single components, and to a multiplicity of components. The term component refers to one or more items that are configured to provide a desired function. The term "signal" includes signals such as currents, voltages, charges, logic signals, data signals, optical signals, electromagnetic waves, as well as others. Referring to the drawings, like numbers indicate like parts throughout the views.

Briefly stated, the present invention is related to a multi-stage amplifier circuit that is arranged to minimize offset related errors (e.g., input referred offset voltage) in a reference circuit. The first stage circuit includes an array of amplifier circuits that receive feedback signals. The outputs of the first stage amplifier circuits are coupled together to a common node. The second stage circuit is also coupled to the common node, and arranged to drive a feedback circuit to generate the feedback signals. In one example, the feedback circuit includes a band-gap core. The second stage circuit can be arranged as part of a low-drop out (LDO) regulator. Each of the amplifier circuits in the first stage can be nulled in response to null control signals from a null control logic circuit. The overall offset in the resulting reference circuit is reduced by the selective nulling of the arrayed amplifiers in the first stage circuit.

FIG. 1 is an illustrative schematic diagram for a circuit (100) that is arranged in accordance with an embodiment of the present invention. Circuit 100 includes a first stage circuit (X1), a second stage circuit (X2), a feedback circuit (X3), and a null control logic circuit (X4).

The first stage circuit (X1) is arranged to receive a feedback signal (FB), a reference signal (REF), and an output signal to a common node. Offset errors in the first stage circuit is selectively nulled by the null control logic circuit (X4) via a set of control signals (e.g., NULL1 through NULLN). The second stage circuit is arranged to receive an input signal from the common node, and also arranged to provide a reference voltage (VREF1) to an output node (OUT). The feedback circuit (X3) is arranged to provide one or more feedback signals (e.g., FB) in response to the reference voltage (VREF1).

First stage circuit X1 includes an array (N) of amplifier circuits that are denoted as amplifier circuits A1 through AN. Each of the amplifier circuits (A1 through AN) includes three inputs and an output. Each of the first inputs is coupled to the feedback signal (FB). Each of the second inputs is coupled to the reference signal (REF) or another feedback signal (e.g., see FIGS. 2–5). Each of the third inputs is coupled to a respective one of the set null control signals (NULL1 through NULLN). Each of the outputs is coupled to the common node. Second stage circuit X2 may include one or more functional blocks. For example, a second stage amplifier circuit may be coupled to an output circuit as shown in FIG. 1. Feedback circuit X3 may be implemented as a voltage divider circuit, a buffer circuit, a source follower circuit, a band-gap core circuit, another amplifier circuit, and/or a combination of other circuits that provide a feedback signal in response to the output signal.

Figure 6:
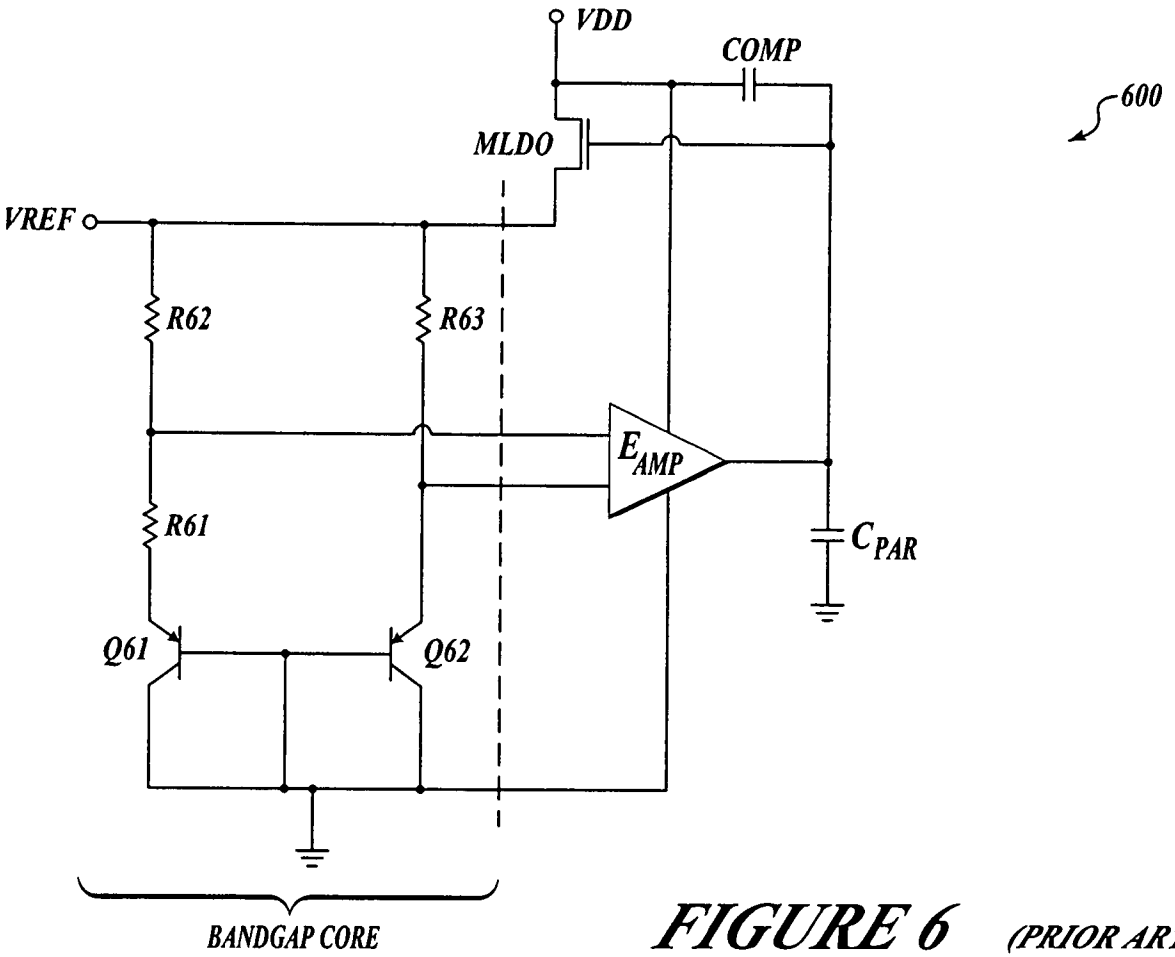
FIGURE 6 (PRIOR ART)
FIG. 6 is an illustrative schematic diagram for a conventional band-gap reference circuit.

Conventional reference circuits such as that depicted in FIG. 6 require some sort of trimming mechanism to adjust the reference voltage (VREF) to a maximally flat response over a specified temperature range. The trimming can be accomplished by adjusting the resistor values in the band-gap core. The trimming in conventional band-gap reference circuits is predominately done to eliminate the mismatch variations in the diode devices (Q61, Q62).

When trimming band-gap references it is often hard to find the appropriate reference voltage for trimming because the absolute value of the optimal reference voltage varies from device to device. The voltage variation is not necessarily due to the mismatch in resistor values or diode devices, but instead is dramatically impacted by offset voltages in the error amplifier (e.g., EAMP). A significant problem that has been observed in addressing the present invention is a phenomenon of assembly related shifts in the reference circuit due to thermal and mechanical stresses on the devices when packaged. For example, a semiconductor die is typically attached to a lead frame in a package where a molding compound is injected over the surface of the die. For this example, the thermal expansion coefficients associated with the molding compound is typically greater than that of the die. The shifts in the reference circuit are predominately the result of variations in the offset in the error amplifier and shifts in resistor values.

Adjustments to the reference voltage in the circuit are typically done by wafer probing, and trimming prior to packaging the device. The adjustments can be lost based on the aforementioned shifts as a result of the mechanical packaging and assembly process. Moreover, the error amplifier and band-gap core circuits may have non-canceling temperature coefficients. Since the temperature coefficients of the offset voltages are likely different, the temperature related drift characteristics that are achieved by trimming the offset voltage at room temperature may be less than ideal.

The present invention addresses the error amplifier offsets using an array of nulled amplifiers as illustrated in FIGS. 1 through 5. Each amplifier (A1–AN) in the first stage circuit is basically a trans-conductance (or gm) cell. The outputs of each of the amplifiers in the first stage circuit are combined at a common node. The common node is used as an input to the second stage circuit, which drives the feedback circuit to provide feedback signals for closed loop operation. By combining a number (N) of amplifiers in parallel, the sigma of the offset based error for the error amplifier (the combined array of amplifiers) corresponds to the offset of an individual amplifier divided by the square root of N. The wideband and 1/f noise are also reduced in the same manner. Switching noise due to the nulling operation is very low, providing a suitable solution for low noise LDO, switching regulator, and voltage reference applications.

The null control logic (X4) is arranged to control the nulling operation for each of the amplifiers via control signal NULL1 through NULLN. The nulling operation for a selected amplifier circuit is accomplished by zeroing one of the selected amplifiers in an "off-line" procedure (see FIG. 4 and related discussion). Examples of nulling and the sequencing of the nulling procedure will be described later.

Figure 2:
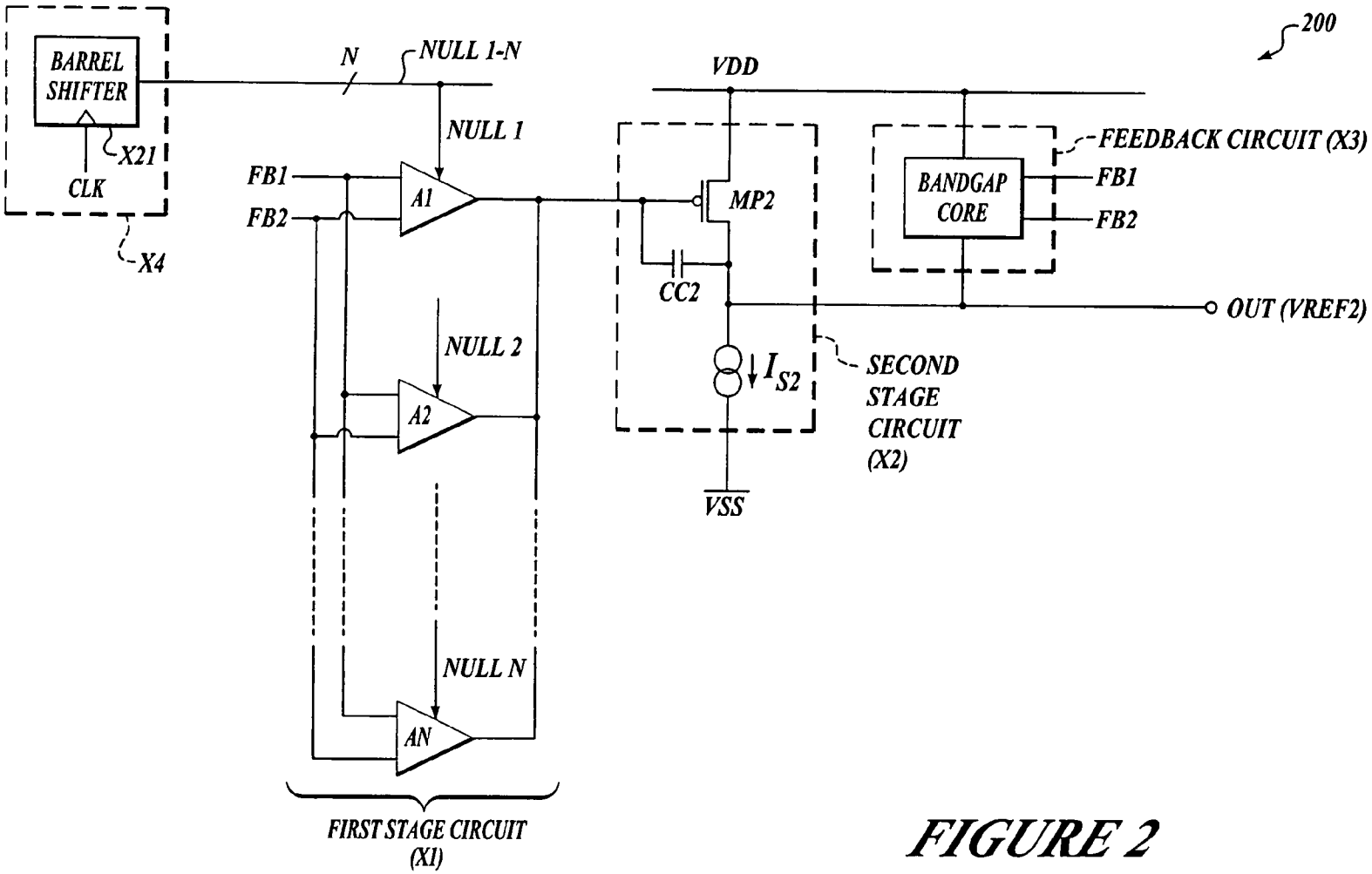

FIG. 2 illustrates another circuit (200) that is arranged according to an embodiment of the present invention. The example illustrated in FIG. 2 is substantially similar to the example illustrated in FIG. 1. The second stage circuit (X2) in FIG. 2 is illustrated as a current source (IS2) and a p-type output transistor (MP2), while the feedback circuit (X3) is illustrated as a band-gap core circuit that includes two output signals (FB1, FB2). A compensation capacitor (CC2) is used to miller compensate the circuit for stability. The null control logic circuit (X4) in FIG. 2 includes a barrel shifter (X21) that is responsive to a clock signal (CLK) to provide the control signals (NULL1–NULLN).

Figure 3:
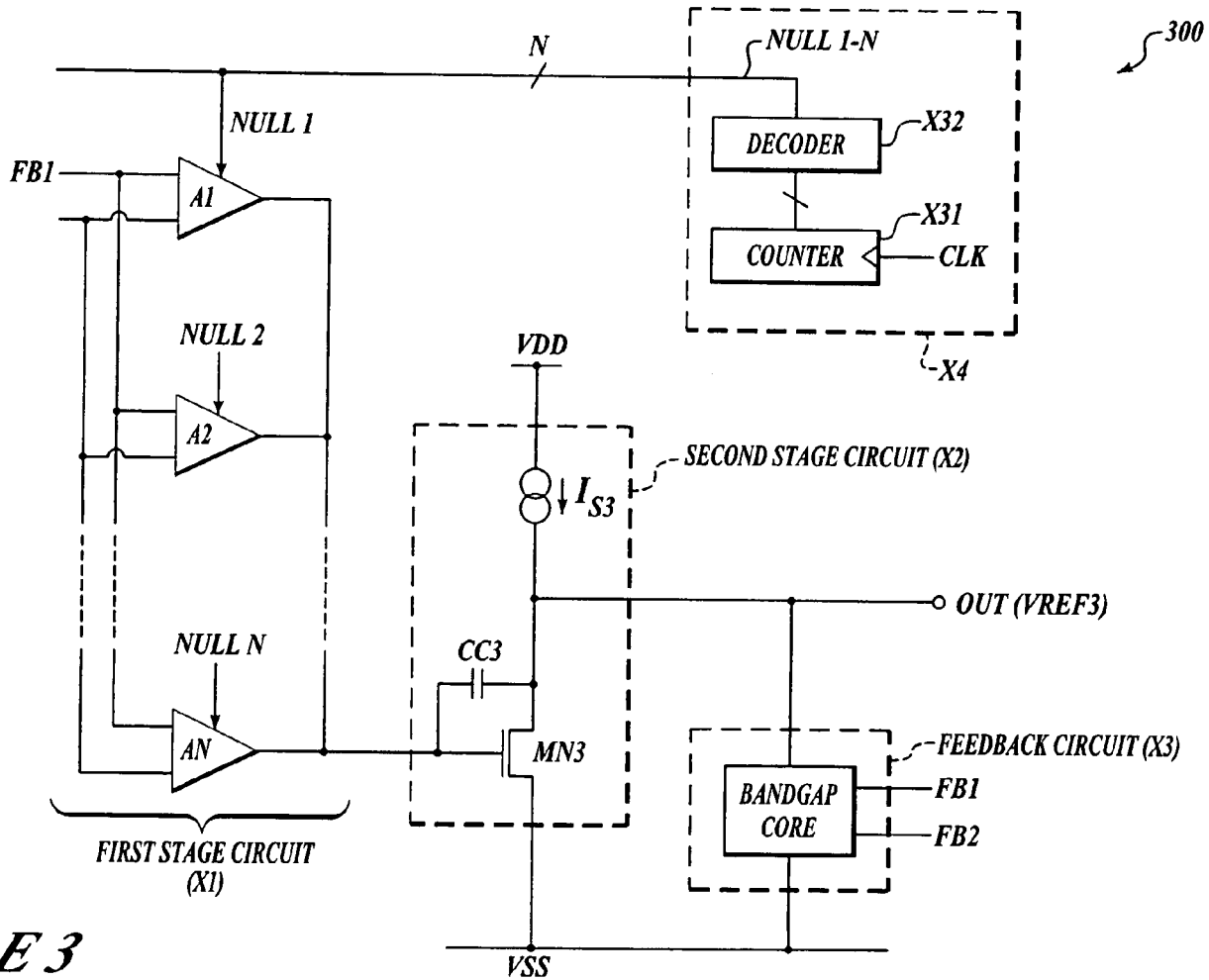

FIG. 3 illustrates yet another circuit (300) that is arranged according to an embodiment of the present invention. The example illustrated in FIG. 3 is substantially similar to the example illustrated in FIG. 2. The second stage circuit (X2) in FIG. 3 is illustrated as a current source (IS3) and an n-type output transistor (MN3), while the feedback circuit (X3) is illustrated as a band-gap core circuit that includes two output signals (FB1, FB2). A compensation capacitor (CC3) is used to miller compensate the circuit for stability. The null control logic circuit (X4) in FIG. 3 includes a counter (X31) that is responsive to a clock signal (CLK), and a decoder (X32) that are arranged to provide the control signals (NULL1–NULLN).

Figure 4:
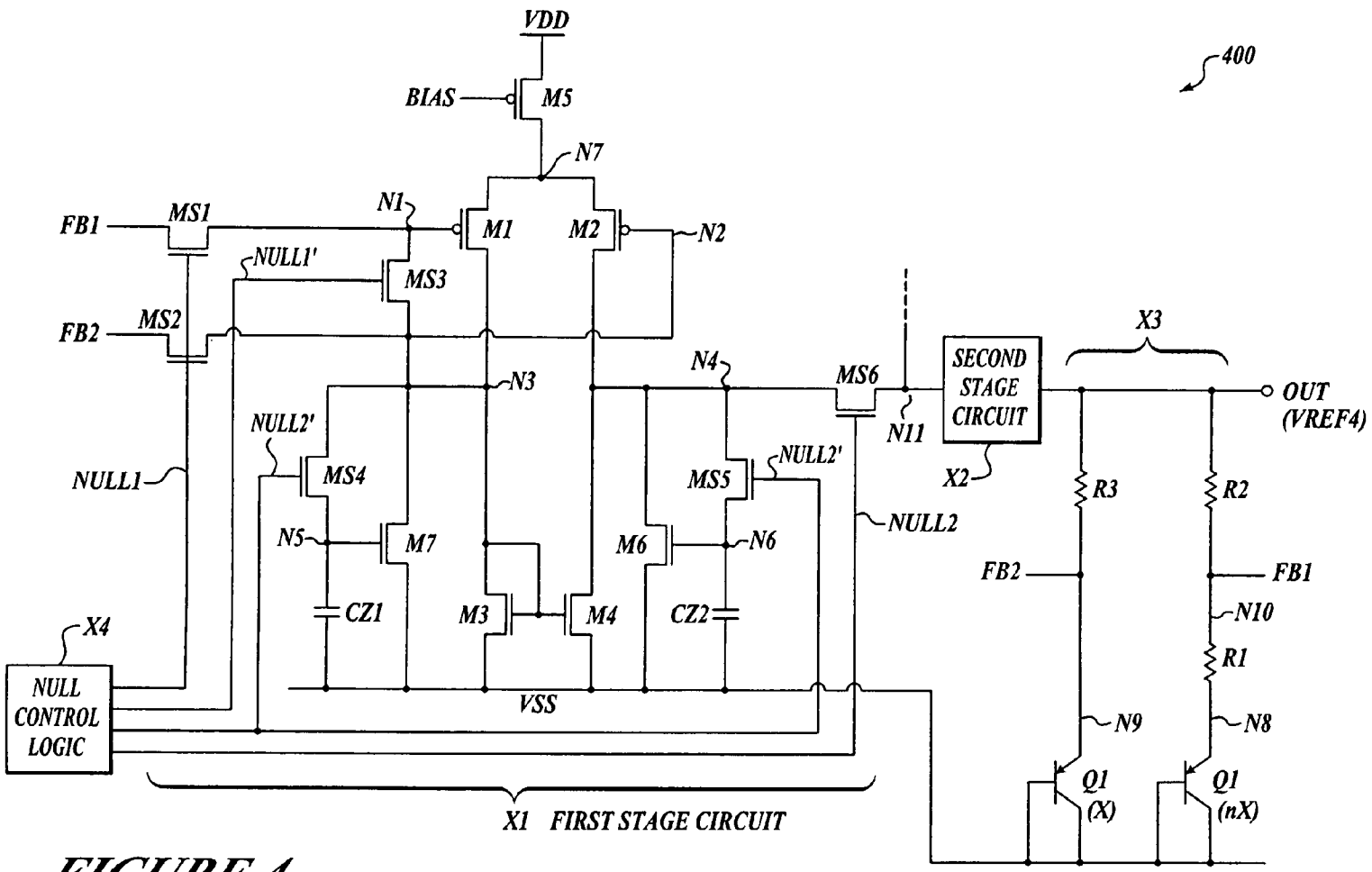

FIG. 4 illustrates still another circuit (400) that is arranged according to an embodiment of the present invention. Circuit 400 includes a first stage circuit (X1), a second stage circuit (X2), a feedback circuit (X3), and a null control logic circuit (X4).

The first stage circuit (X1) includes is arranged to receive two feedback signals (FB1, FB2), and provides an intermediate signal at a common node (N4). The second stage circuit (X2) is arranged to provide an output signal (VREF4) at output node OUT in response to the intermediate signal from node N4. The feedback circuit (X3) is arranged as a band-gap core circuit that provides feedback signals FB1 and FB2 in response to the output signal. The null control logic circuit (X4) is arranged to provide timing signals (NULL1, NULL1', NULL2, NULL2') for nulling an amplifier in the first stage circuit (X1).

An example amplifier circuit is represented in FIG. 4 by seven transistors (M1–M7), six switches that are illustrated by transistors MS1 through MS6, and two capacitors (CZ1, CZ2). Transistor M1 includes a source that is coupled to node N7, a gate that is coupled to node N1, and a drain that is coupled to node N3. Transistor M2 includes a source that is coupled to node N7, a gate that is coupled to node N2, and a drain that is coupled to node N4. Transistor M3 includes a source that is coupled to VSS, and a gate and drain that are coupled to node N3. Transistor M4 includes a source that is coupled to VSS, a gate that is coupled to node N3, and a drain that is coupled to node N4. Transistor M5 includes a source that is coupled to VDD, a gate that is coupled to a bias signal (BIAS), and a drain that is coupled to node N7. Transistor M6 includes a source that is coupled to VSS, a gate that is coupled to node N6, and a drain that is coupled to node N4. Transistor M7 includes a source that is coupled to VSS, a gate that is coupled to node N5, and a drain that is coupled to node N3. Transistor MS1 ncludes a source and drain that are coupled between node N1 and feedback signal FB1, and a gate that is coupled to signal NULL1. Transistor MS2 includes a source and drain that are coupled between node N2 and feedback signal FB2, and a gate that is coupled to signal NULL1. Transistor MS3 includes a source and drain that are coupled between node N1 and node N2, and a gate that is coupled to signal NULL1'. Transistor MS4 includes a source and drain that are coupled between node N3 and node N5, and a gate that is coupled to signal NULL2'. Transistor MS5 includes a source and drain that are coupled between node N4 and node N6, and a gate that is coupled to signal NULL2'. Transistor MS6 includes a source and drain that are coupled between node N4 and N11, and a gate that is coupled to signal NULL2. Capacitor CZ1 is coupled between node N5 and VSS. Capacitor CZ2 is coupled between node N6 and VSS.

Transistors M1–M5 are arranged as a trans-conductance cell, where transistor M5 is arranged as a current source, transistors M1 and M2 are arranged as a differential pair, and transistors M3 and M4 are arranged in a current mirror configuration. Transistors MS1, MS2 and MS6 are operated as closed switches when the amplifier circuit is online. When the amplifier circuit is offline, transistors MS1 and MS2 operate as open switches such that the feedback signals are isolated from the input of the differential pair. Similarly, the output of the amplifier circuit is isolated from loading down the other on-line amplifiers by operating transistor MS6 as an open switch when the amplifier circuit is offline.

During one zeroing phase, nulling signal NULL1 is deasserted such that transistors MS1 and MS2 are operated as an open circuit switch that isolates signals FB1 and FB2 from nodes N1 and N2, respectively. During another zeroing phase, signal NULL1' is asserted such that transistor MS3 is operated as closed switch where the inputs of the differential pair are coupled together. Nulling signals NULL1 and NULL1' are preferably arranged for non-overlapping operation such that the inputs of the differential pair are shorted together after the feedback signals (FB1, FB2) are isolated from the differential pair at nodes N1 and N2. For the example illustrated in FIG. 4, transistors MS1 and MS2 are preferably matched to one another so that their switching operation results in charge injection effects and glitch effects that are matched on both signal lines (FB1, FB2). The remaining online amplifier circuits will reject the matched glitches since they are common-mode signals.

During still another zeroing phase, nulling signal NULL2 is deasserted such that transistor MS6 is operated as an open switch when off-line. During yet another zeroing phase, transistors MS4 and MS5 are operated as closed switches such that transistor MS4 configures transistor M7 to operate as a diode and MS5 configures transistor M6 to operate as another diode. Capacitors CZ1 and CZ2 store the zero condition such that the amplifier is nulled. Nulling signals NULL2 and NULL2' are preferably arranged for non-overlapping operation such that the output of the amplifier circuit is isolated from the other on-line amplifiers before the nulling operation is performed.

The band-gap core circuit (X3) is represented by two p-type transistors (Q1, Q2) and three resistors (R1–R3). Transistor Q1 includes a collector that is coupled to VSS, a base and emitter that are coupled to node N8, and has an effective area corresponding to nX. Transistor Q2 includes a collector that is coupled to VSS, a base and emitter that are coupled to node N9, and has an effective area corresponding to X. Resistor R1 is coupled between node N8 and node N10. Resistor R2 is coupled between node N10 and OUT. Resistor R3 is coupled between node N9 and OUT. Node N10 is associated with the first feedback signal (FB1), while node N9 is associated with the second feedback signal (FB2).

Figure 5:
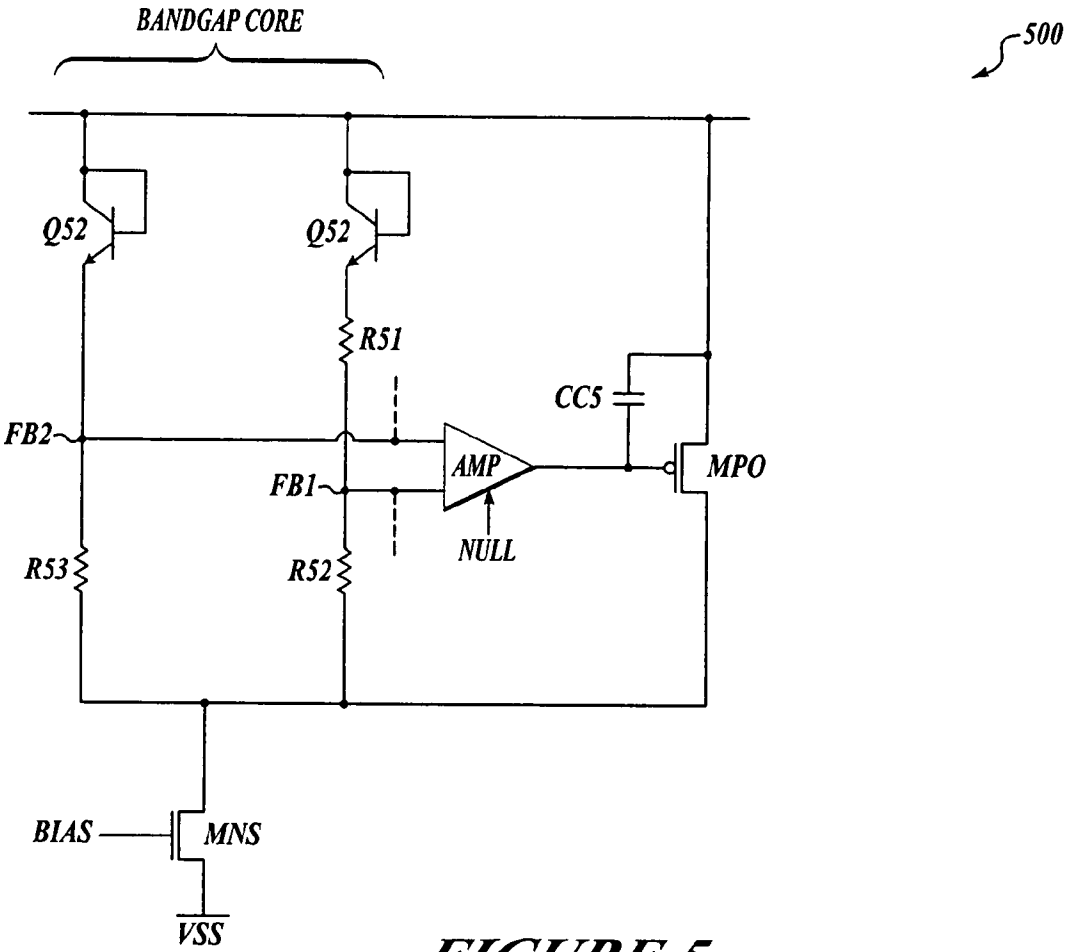

FIG. 5 illustrates yet another circuit (500) that is arranged according to an embodiment of the present invention. Circuit 500 includes a first stage circuit that is represented as an amplifier (AMP), a second stage circuit that is represented by transistor MPO and current source transistor MNS, and a feedback circuit that is represented as a band-gap core. The operation of circuit 500 is substantially similar to that described with respect to FIGS. 1 through 4 previously.

An example nulling procedure can be implemented by selecting each of the amplifiers in turn. Each amplifier circuit that is selected is initialized to a nulled condition such that the offset is zeroed out. After every one of the amplifiers is taken offline, the cycle repeats such that the overall offset in the system is zero. This example nulling procedure can be implemented with a null logic circuit that includes a shift register such as a barrel shifter as illustrated in FIG. 2, a counter and a decoder as illustrated in FIG. 3, or any other appropriate sequencing logic circuit. An example offset nulling sequence for a set of four amplifiers is illustrated below with offsets corresponding to +2 mV, +1 mV, −3 mV, and −2 mV, respectively.

| Time | Offset A1 | Offset A2 | Offset A3 | Offset A4 | Avg Offset |
|---|---|---|---|---|---|
| t0 | +2.0 mV | +1.0 mV | −3.0 mV | −2.0 mV | −0.50 mV |
| t1 | 0.0 mV | +1.0 mV | −3.0 mV | −2.0 mV | −1.00 mV |
| t2 | 0.0 mV | 0.0 mV | −3.0 mV | −2.0 mV | −1.25 mV |
| t3 | 0.0 mV | 0.0 mV | 0.0 mV | −2.0 mV | −0.5 mV |
| t4 | 0.0 mV | 0.0 mV | 0.0 mV | 0.0 mV | 0.0 mV |

As described above, a shift register (e.g., a barrel shifter) or a counter and decoder can be used in the null control logic to cycle through the amplifiers for nulling each one in turn. In another example, each of the amplifiers is nulled during a power-on-reset (POR) sequence. In still another exampled every other amplifier is nulled in sequence over time. A clock signal or a free running oscillator can be used to synchronize timing in the null control logic circuit (X4).

Another example nulling procedure for four amplifiers is described below, where the amplifiers offsets initially correspond to +2 mV, +1 mV, −3 mV, and −2 mV, respectively. For this example, one amplifier (i.e., the seed amplifier) is initially zeroed out so that the average offset that asymptotically approaches zero.

| Time | Offset A1 | Offset A2 | Offset A3 | Offset A4 | Avg Offset |
|---|---|---|---|---|---|
| t0 | +2.0 mV | +1.0 mV | −3.0 mV | −2.0 mV | −0.50 mV |
| t1 | 0.0 mV | +1.0 mV | −3.0 mV | −2.0 mV | −1.00 mV |
| t2 | 0.0 mV | −1.0 mV | −3.0 mV | −2.0 mV | −1.50 mV |
| t3 | 0.0 mV | −1.0 mV | −1.5 mV | −2.0 mV | −1.25 mV |
| t4 | 0.0 mV | −1.0 mV | −1.5 mV | −1.25 mV | −0.94 mV |

The above description illustrates an example of how the average offset of the amplifiers might be nulled. For this example, the seed amplifier is initially zeroed at time t1. As time progresses, the average offset associated with the array of amplifiers asymptotically approaches zero. However, one amplifier is taken offline at any given time so that glitches in the system are minimized.

Other example null control logic arrangements are considered within the scope of the present invention. For example, a randomizer can be used to randomly null amplifiers such that the spectrum of the switching noise is spread over many frequencies.

The above specification, examples and data provide a complete description of the manufacture and use of the composition of the invention. Since many embodiments of the invention can be made without departing from the spirit and scope of the invention, the invention resides in the claims hereinafter appended.

I claim:

1. An apparatus, comprising:

a first stage circuit that includes an array of amplifier circuits, wherein each of the amplifier circuits includes: an offset adjustment circuit, an output that is coupled to a common node, an input that is arranged to receive a feedback signal, and a null control input that is arranged to receive a respective null control signal such that each respective offset adjustment circuit is arranged to remove a respective input referred offset for a respective one of the amplifier circuits in response to each respective null control signal, wherein each respective null control signal is independent of one another;

a second stage circuit that is arranged to provide a reference signal to an output node in response to an intermediate signal that is associated with the common node;

a feedback circuit that is arranged to provide the feedback signal in response to the reference signal, wherein the feedback circuit includes a band-gap core circuit, wherein the band-gap core circuit comprises: a first bipolar junction transistor that is arranged in a common-base configuration with a second bipolar junction transistor, and a resistor that is coupled to the second bipolar junction transistor, wherein the first bipolar junction transistor has a first base-emitter voltage given as VBE1, the second bipolar junction transistor has a second base-emitter voltage given as VBE2, and a voltage across the resistor is given as delta VBE, wherein the first stage circuit, the second stage circuit, and the feedback circuit are arranged for closed-loop operation with the band-gap core circuit such that VBE1=VBE2+delta VBE; and a null control logic circuit that is arranged to provide a set of null control signals, where each null control signal is associated with a respective one of the amplifier circuits such that the amplifier circuits are selectively zeroed to minimize the effects of offset in each of the amplifier circuits.

2. The apparatus of claim 1, wherein each of the amplifier circuits in the first stage circuit includes a differential pair circuit, wherein each differential pair circuit comprises at least one of: an n-type transistor pair, a p-type transistor pair, a FET type transistor pair, and a BJT type transistor pair.

3. The apparatus of claim 1, wherein at least one of the amplifier circuits includes a trans-conductance cell, wherein the trans-conductance cell comprises: a differential pair circuit that is coupled to a current mirror circuit, wherein the differential pair circuit is arranged to: receive a differential signal from a first node and a second node, and provide at least a portion of the intermediate signal to the common node in response to the differential signal.

4. The apparatus of claim 1, wherein at least one of the amplifier circuits includes a switching circuit that is arranged to selectively zero the offset voltage associated with the trans-conductance cell in response to a selected one of the null control signals.

5. An apparatus, comprising:

a first stage circuit that includes an array of amplifier circuits, wherein each of the amplifier circuits includes: an offset adjustment circuit, an output that is coupled to a common node, an input that is arranged to receive a feedback signal, and a null control input that is arranged to receive a respective null control signal such that the offset adjustment circuit for a respective one of the amplifier circuits is responsive to the respective null control signal;

a second stage circuit that is arranged to provide a reference signal to an output node in response to an intermediate signal that is associated with the common node;

a feedback circuit that is arranged to provide the feedback signal in response to the reference signal, wherein the feedback circuit includes a band-gap core circuit; and a null control logic circuit that is arranged to provide a set of null control signals, where each null control signal is associated with a respective one of the amplifier circuits such that the amplifier circuits are selectively zeroed to minimize the effects of offset in each of the amplifier circuits, wherein at least one of the amplifier circuits comprises:

a trans-conductance cell, wherein the trans-conductance cell comprises: a differential pair circuit that is coupled to a current mirror circuit, wherein the differential pair circuit is arranged to: receive a differential signal from a first node and a second node, and provide at least a portion of the intermediate signal to the common node in response to the differential signal; and a switching circuit that is arranged to selectively zero the offset voltage associated with the trans-conductance cell in response to a selected null control signals.

6. The apparatus of claim 5, wherein the switching circuit is further arranged to selectively couple the differential signal across the first node and the second node when the selected null control signal is deasserted.

7. The apparatus of claim 5, wherein the switching circuit is further arranged to selectively couple the first and second nodes together when the selected null control signal is asserted.

8. The apparatus of claim 5, wherein the switching circuit is further arranged to selectively couple the differential signal across the first node and the second node when the selected null control signal is deasserted, and also arranged to selectively couple the first and second nodes together when another selected null control signal is asserted.

9. The apparatus of claim 8, wherein the switching circuit is further arranged to: selectively couple a first capacitor to the third node when the other null control signal is asserted, and selectively couple a second capacitor to the common node when the other null control signal is asserted.

10. An apparatus comprising:

a first stage circuit that includes an array of amplifier circuits, wherein each of the amplifier circuits includes: an offset adjustment circuit, an output that is coupled to a common node, an input that is arranged to receive a feedback signal, and a null control input that is arranged to receive a respective null control signal such that the offset adjustment circuit for a respective one of the amplifier circuits is responsive to the respective null control signal; wherein at least one of the amplifier circuits includes a trans-conductance cell that comprises:

a first transistor that includes a source that is coupled to a seventh node, a gate that is coupled to a first node, and a drain that is coupled to a third node;

a second transistor that includes a source that is coupled to the seventh node, a gate that is coupled to the second node, and a drain that is coupled to the common node;

a third transistor that includes a source that is coupled to a power supply node, a gate that is coupled to the third node, and a drain that is coupled to the common node;

a fourth transistor that includes a source that is coupled to the power supply node, and a gate and drain that are coupled to the third node; and a fifth transistor that is arranged to operate as a current source that is coupled to the seventh node;

a second stage circuit that is arranged to provide a reference signal to an output node in response to an intermediate signal that is associated with the common node;

a feedback circuit that is arranged to provide the feedback signal in response to the reference signal, wherein the feedback circuit includes a band-gap core circuit; and a null control logic circuit that is arranged to provide a set of null control signals, where each null control signal is associated with a respective one of the amplifier circuits such that the amplifier circuits are selectively zeroed to minimize the effects of offset in each of the amplifier circuits.

11. The apparatus of claim 10, further comprising:

a sixth transistor that include a source that is coupled to the power supply node, a gate that is coupled to a sixth node, and a drain that is coupled to the common node;

a seventh transistor that include a source that is coupled to the power supply node, a gate that is coupled to a fifth node, and a drain that is coupled to the third node;

a first capacitor that is coupled between the fifth node and the power supply node;

a second capacitor that is coupled between the sixth node and the power supply node;

a fourth switching transistor that is arranged to selectively couple the fifth node to the third node when actuated; and a fifth switching transistor that is arranged to selectively couple the sixth node to the common node when actuated.

12. The apparatus of claim 11, further comprising:

a first switching transistor that is arranged to couple the feedback signal to the first node when actuated;

a second switching transistor that is arranged to couple a reference signal to the second node when actuated; and a third switching transistor that is arranged to couple the first node to the second node when actuated.

13. The apparatus of claim 1, wherein the first stage circuit, the second stage circuit, the feedback circuit, and the feedback circuit are configured to operate as at least one of: a switching regulator circuit, a reference voltage circuit, a low drop out (LDO) regulator circuit, and a band-gap reference circuit.

14. An apparatus comprising:

a first stage circuit that includes an array of amplifier circuits, wherein each of the amplifier circuits includes: an offset adjustment circuit, an output that is coupled to a common node, an input that is arranged to receive a feedback signal, and a null control input that is arranged to receive a respective null control signal such that the offset adjustment circuit for a respective one of the amplifier circuits is responsive to the respective null control signal;

a second stage circuit that is arranged to provide a reference signal to an output node in response to an intermediate signal that is associated with the common node;

a feedback circuit that is arranged to provide the feedback signal in response to the reference signal, wherein the feedback circuit includes a band-gap core circuit, wherein the band-gap core circuit comprises: a first transistor that is coupled between a power supply node and a first node, a second transistor that is coupled between the power supply node and a second node, a first resistor that is coupled between the first node and a third node, a second resistor that is coupled between the third node and the output node, and a third resistor that is coupled between the second node and the output node, wherein the feedback signal is associated with at least one of the second node and the third node; and a null control logic circuit that is arranged to provide a set of null control signals, where each null control signal is associated with a respective one of the amplifier circuits such that the amplifier circuits are selectively zeroed to minimize the effects of offset in each of the amplifier circuits.

15. An apparatus, comprising:

a first amplifier means that includes a first offset adjustment circuit, a first output that is coupled to a common node, a first input that is arranged to receive a feedback signal, and a first null control input that is arranged to couple a first null control signal to the first offset adjustment circuit such that the first offset adjustment circuit is arranged to remove a first input referred offset associated with the first amplifier means in response to the first null control signal;

a second amplifier means that includes a second offset adjustment circuit, a second output that is coupled to the common node, a second input that is arranged to receive the feedback signal, and a second null control input that is arranged to couple a second null control signal to the second offset adjustment circuit such that the second offset adjustment circuit is arranged to remove a second input referred offset associated with the second amplifier means in response to the second null control signal;

a third amplifier means that includes a third offset adjustment circuit, a third output that is coupled to the common node, a third input that is arranged to receive the feedback signal, and a third null control input that is arranged to couple a third null control signal to the third offset adjustment circuit such that the third offset adjustment circuit is arranged to remove a third input referred offset associated with the third amplifier means in response to the third null control signal, wherein the first, second, and third null control signals are independent of one another;

a second stage means that is arranged to provide a reference signal in response to an intermediate signal, wherein the intermediate signal is associated with the common node;

a feedback means that is arranged to provide the feedback signal in response to the reference signal, wherein the feedback means includes a band-gap core means, wherein the band-gap core means comprises: a first bipolar junction transistor that is arranged in a common-base configuration with a second bipolar junction transistor, and a resistor that is coupled to the second bipolar junction transistor, wherein the first bipolar junction transistor has a first base-emitter voltage given as VBE1, the second bipolar junction transistor has a second base-emitter voltage given as VBE2, and a voltage across the resistor is given as delta VBE, wherein the first stage circuit, the second stage circuit, and the feedback circuit are arranged for closed-loop operation with the band-gap core means such that VBE1=VBE2+delta VBE; and a null control means that is arranged to provide the first, second, and third null control signals such that an offset voltage associated with one of the first, second, and third amplifiers means is selectively zeroed in response to the respective one of the first, second, and third null control signals while the others of the first, second, and third amplifier means are not zeroed.

16. The apparatus of claim 15, wherein the null control means comprises at least one of a shift register, a barrel shifter, a counter, an oscillator, a randomizer, and a power-on-reset circuit.

17. The apparatus of claim 15, wherein the null control means is further arranged to activate one of the first and second null control signals at a time.

18. The apparatus of claim 15, wherein the null control means is further arranged to assert one of the first, second, and third null control signals when the others of the first, second, and third null control signals are deasserted.

19. A method for reducing the offset voltage associated with a reference signal, comprising:

coupling together the outputs from an array of amplifier circuits at a common node to provide an intermediate signal, wherein each of the amplifier circuits includes an offset adjustment circuit therein;

coupling the common node to a second stage circuit;

generating the reference signal as an output of the second stage circuit that is responsive to the intermediate signal;

providing a feedback signal to the array of amplifier circuits in response to the reference signal, wherein the feedback signal is associated with a band-gap core circuit, wherein the band-gap core circuit comprises: a first bipolar junction transistor that is arranged in a common-base configuration with a second bipolar junction transistor, and a resistor that is coupled to the second bipolar junction transistor, wherein the first bipolar junction transistor has a first base-emitter voltage given as VBE1, the second bipolar junction transistor has a second base-emitter voltage given as VBE2, and a voltage across the resistor is given as delta VBE;

selecting one of the array of amplifier circuits for offline operation;

nulling an offset voltage associated with the selected amplifier circuit while the selected amplifier circuit is in offline operation;

controlling the non-selected amplifier circuits with the feedback signal for closed-loop operation with the band-gap core circuit such that VBE1=VBE2+delta VBE; and maintaining the non-selected amplifier circuits such that the offset voltage associated with the reference signal is zeroed as an average.

20. An apparatus that is arranged to provide a reference signal, comprising:

a feedback circuit that is arranged to provide a feedback signal that is responsive to the reference signal, wherein the feedback circuit includes a band-gap core circuit, wherein the band-gap core circuit comprises: a first bipolar junction transistor that is arranged in a common-base configuration with a second bipolar junction transistor, and a resistor that is coupled to the second bipolar junction transistor, wherein the first bipolar junction transistor has a first base-emitter voltage given as VBE1, the second bipolar junction transistor has a second base-emitter voltage given as VBE2, and a voltage across the resistor is given as delta VBE;

an output circuit that is arranged to provide the reference signal in response to an output control signal;

a null control logic circuit that is arranged to provide a first control signal, a second control signal, and a third control signal such that one of the first, second, and third control signals is asserted while the other of the first, second, and third control signals is deasserted; and an error amplifier circuit that is arranged to provide the output control signal in response to the feedback signal and another reference signal, wherein the feedback circuit, the output circuit, and the error amplifier circuit are arranged for closed-loop operation with the band-gap core means such that VBE1=VBE2+delta VBE, wherein the error amplifier circuit comprises:

a first amplifier circuit that includes a first inverting input that is coupled to a first node, a first non-inverting input that is coupled to a second node, a first output that is coupled to a common node, and a first control input that is arranged to receive the first control signal;

a first offset adjustment circuit that is integrally formed with the first amplifier circuit, wherein the first offset adjustment circuit is enabled in response to the first control signal;

a second amplifier circuit that includes a second inverting input that is coupled to the first node, a second non-inverting input that is coupled to the second node, a second output that is coupled to the common node, and a second control input that is arranged to receive the second control signal;

a second offset adjustment circuit that is contained within the second amplifier circuit, wherein the second offset adjustment circuit is enabled in response to the second control signal;

a third amplifier circuit that includes a third inverting input that is coupled to the first node, a third non-inverting input that is coupled to the third node, a third output that is coupled to the common node, and a third control input that is arranged to receive the third control signal;

a third offset adjustment circuit that is contained within the third amplifier circuit, wherein the third offset adjustment circuit is enabled in response to the third control signal, wherein: the feedback signal is coupled to one of the first and second nodes, the other reference signal is coupled to an other of the first and second node, and the first, second, and third control signals are operated independent of one another; and a second stage amplifier circuit that is arranged to provide the output control signal in response to an intermediate signal that is associated with the common node.

21. A voltage reference circuit, comprising:

an offset adjustment control logic circuit that is arranged to provide an array of control signals that are each independent of one another, wherein the offset adjustment control logic circuit is configured such that one of the control signals is asserted when another of the control signals is de-asserted;

a first stage circuit comprising an array of amplifier circuits, wherein each of the array of amplifier circuits comprises an amplifier input terminal that is configured to receive a feedback signal, an amplifier output terminal that is coupled to a common node, an offset adjustment control terminal that is configured to receive a corresponding one of the array of control signals, wherein each of the array of amplifier circuits is arranged to:

selectively configure the amplifier circuit for operation in an on-line condition when the corresponding control signal is de-asserted;

selectively configure the amplifier circuit for operation in an off-line condition when the corresponding control signal is asserted;

selectively provide an output signal at the common node when the amplifier circuit is operated in the on-line condition, wherein the output signals from each of the amplifier circuits that are operated in the on-line condition are combined at the common node to provide an intermediate signal;

selectively isolate the output signal from the common node when the amplifier circuit is operated in the off-line condition such that that output signals from each of the amplifier circuits that are operated in the off-line condition are isolated from the intermediate signal at the common node; and adjustably remove an input referred offset associated with each amplifier circuit that is operated in the off-line condition;

a second stage circuit comprising: a second stage input terminal that is configured to receive the intermediate signal from the common node, and a second stage output terminal that is configured to provide a reference signal to an output node of the voltage reference circuit such that the reference signal is responsive to changes in the intermediate signal; and a feedback circuit that is arranged to provide the feedback signal in response to the reference signal, wherein the feedback circuit comprises: a first bipolar junction transistor that is arranged in a common-base configuration with a second bipolar junction transistor, and a resistor that is coupled to the second bipolar junction transistor, wherein the first bipolar junction transistor, the second bipolar junction transistor and the resistor are arranged in a band-gap circuit configuration such that: the first bipolar junction transistor has a first base-emitter voltage given as VBE1, the second bipolar junction transistor has a second base-emitter voltage given as VBE2, and a voltage across the resistor corresponds to a difference between VBE1 and VBE2.

22. A method for reducing the offset voltage associated with a reference signal, comprising:

coupling an output from a first stage circuit to an input of a second stage circuit at a common node, wherein an input of the first stage circuit corresponds to an input of an error amplifier circuit, and wherein an output from the second stage circuit corresponds to an output of the error amplifier circuit;

arranging the error amplifier circuit in a closed-loop feedback arrangement with a band-gap core circuit such that a feedback signal from the band-gap core circuit is coupled to the input of the error amplifier circuit, and the output of the error amplifier circuit is arranged in cooperation with the band-gap core circuit to generate the reference signal, wherein the band-gap core circuit comprises: a first bipolar junction transistor that is arranged in a common-base configuration with a second bipolar junction transistor, and a resistor that is coupled to the second bipolar junction transistor, wherein the closed-loop feedback arrangement is configured such that the first bipolar junction transistor has a first base-emitter voltage given as VBE1, the second bipolar junction transistor has a second base-emitter voltage given as VBE2, and a voltage across the resistor is given as delta VBE;

arranging an array of amplifier circuits as the first stage circuit, wherein each amplifier circuit includes a respective output node that is selectively coupled to the common node when operated in an online condition such that the output node from each amplifier circuit that is operated in the online condition is coupled to the common node, and an intermediate signal is observed at the common node from the amplifier circuits that are operated in the online condition;

selecting one of the array of amplifier circuits for operation in an offline condition to provide an offline amplifier, wherein the others of the array of amplifier circuits are operated in the online condition;

isolating the output node for the offline amplifier from the common node such that any signal change observed at the output node of the offline amplifier does not effect the intermediate signal;

adjustably removing an input referred offset associated with the offline amplifier; and periodically changing the selection of the offline amplifier such that each of the array of amplifier circuits is individually selected over time, whereby the offset voltage associated with the reference signal is zeroed as an average.

* * * * *

UNITED STATES PATENT AND TRADEMARK OFFICE

CERTIFICATE OF CORRECTION

PATENT NO. : 7,142,042 B1
APPLICATION NO. : 10/651849
DATED : November 28, 2006
INVENTOR(S) : Paul M. Henry It is certified that error appears in the above-identified patent and that said Letters Patent is hereby corrected as shown below:

Column 8, Line 32: "null control signals" should read -- null control signal --

Column 9, Line 53: "the feedback circuit, and the feedback circuit" should read -- and the feedback circuit --

Signed and Sealed this

Thirteenth Day of March, 2007

JON W. DUDAS
*Director of the United States Patent and Trademark Office*